US009687854B2

(12) United States Patent
Tsai et al.

(10) Patent No.: US 9,687,854 B2
(45) Date of Patent: Jun. 27, 2017

(54) SHREDDER JAM CLEAR APPARATUS

(71) Applicants: Chung Shih Tsai, Hawthorne, CA (US); Yung Kang Tso, Shanghai (CN); Xiuming Liu, Shanghai (CN)

(72) Inventors: Chung Shih Tsai, Hawthorne, CA (US); Yung Kang Tso, Shanghai (CN); Xiuming Liu, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 335 days.

(21) Appl. No.: 14/663,422

(22) Filed: Mar. 19, 2015

(65) Prior Publication Data

US 2016/0271617 A1 Sep. 22, 2016

(51) Int. Cl.
*B02C 18/16* (2006.01)
*B02C 18/00* (2006.01)

(52) U.S. Cl.
CPC ..... *B02C 18/0007* (2013.01); *B02C 18/16* (2013.01); *B02C 2018/0023* (2013.01); *B02C 2018/0046* (2013.01); *B02C 2018/164* (2013.01)

(58) Field of Classification Search
CPC ..... B02C 18/0007; B02C 18/16; B02C 2018/0023; B02C 2018/164; B02C 2018/0046
See application file for complete search history.

(56) References Cited

U.S. PATENT DOCUMENTS

2006/0054725 A1* 3/2006 Matlin ..... B02C 18/0007 241/37.5

* cited by examiner

*Primary Examiner* — Mark Rosenbaum
(74) *Attorney, Agent, or Firm* — WHGC, P.L.C.; John O'Rourke

(57) ABSTRACT

A paper shredder having shredder cover and a motor coupled to shredder blades includes a shredder throat coupled to an inlet in the shredder cover and in proximity to shredder blades. The shredder throat has a moveable throat blade, which widens the shredder throat. An anti-jam switch, which when activated causes the motor to advance the shredder blades to clear a jam in the widened shredder throat. The jam clearing mechanism can be automatic or manual, as by push-button or turn-knob linkages. A method for recovering from a shredder jam in a paper shredder is provided, including providing a moveable throat blade; sensing a shredder throat jammed condition; releasing the moveable throat blade; moving the moveable throat blade to a wide gap position; sensing the moveable throat blade in the wide gap position; advancing shredder blades in response to the sensing, by which the jammed condition is cleared.

20 Claims, 14 Drawing Sheets

SHREDDER JAM CLEAR APPARATUS

BACKGROUND

1. Field of the Invention

The present invention relates to paper shredders and, more particularly, to apparatus and methods for clearing jams in paper shredders.

2. Background Art

A shredder inlet has an opening and a throat, formed from at least two throat blades. The inlet receives the material to be shredded and the throat blades direct that material to the shredder blades. The shredder blades convert the material into shreddant, i.e., shredded material. In a typical shredder, the throat blades are fixed, and may be rigid, to prevent fingers and unacceptable items from being pushed into contact with the shredder blades. Some throat blades do not lead to the shredder blades in a straight line, but are disposed at an angle from the opening to further impede the progress of fingers and unacceptable items towards the shredder blades. Typically, a throat has a predetermined opening, that is, the throat blades are spaced apart such that a predetermined mass of material, usually measured in sheets of paper, can successfully be comminuted (shredded). For example, a throat may be about 4 mm wide, to accommodate 6 standard sheets of paper. Exceeding the predetermined mass of material being introduced into a throat can cause a "jam," in which the mass of shredding material being comminuted exceeds the shredder's capability and a wad of partly-shredded material is lodged in the entrance to the shredder blades, causing the shredder motor to momentarily fail. At present, many shredders provide no solution for jams other than to have the user remove the cover of the shredder, which contains the opening and the throat, and expose the jam—and more importantly—the shredder blades. In this case, the user must pull the partially shredded wad from the jaws of the blades, exposing the user to receiving cuts from the blades.

SUMMARY

Described are apparatus and methods for clearing a jam in a paper shredder. In apparatus embodiments, a paper shredder having shredder cover and a motor coupled to shredder blades, includes a shredder throat, coupled to an inlet in the cover and in proximity to the shredder blades. The shredder throat has a moveable throat blade, in which the moveable throat blade widens the shredder throat. The paper shredder embodiments also include an anti-jam switch capable of being activated, and wherein upon activating the motor advances the shredder blades to clear a jam in the widened shredder throat. In some embodiments, the moveable throat blade is moved manually. Also, the anti-jam switch is activated by contact with the moveable throat blade. In some embodiments, the moveable blade is moved with a push-button linkage accessible by the shredder cover, and the moveable blade when widened activates the anti-jam switch.

In other embodiments, the moveable blade is moved with a turn-knob linkage accessible by the shredder cover, and the moveable blade, when widened, activates the anti jam switch. In still other embodiments, the anti jam switch is activated by a user contacting a switch button on a shredder cover after moving the moveable throat blade. In yet other embodiments, the moveable blade widens the shredder throat automatically upon a signal. In yet additional embodiments, the anti-jam switch activates automatically upon a signal. In some of these embodiments, the signal is a torque-based measurement from the motor. In others, a force sensor is disposed in the moveable blade capable of sensing a jam in the shredder throat and the signal is a force signal from the moveable blade.

In method embodiments, a method for recovering from a shredder jam in a paper shredder is provided, including providing a moveable throat blade in the shredder throat; sensing a shredder throat jammed condition; releasing the moveable throat blade in the shredder throat; moving the moveable throat blade to a wide gap position; sensing the moveable throat blade in the wide gap position; advancing shredder blades in response to the sensing, wherein the jammed condition is cleared; returning the moveable throat blade to a nominal gap position; and turning off the shredder blades in response to the returning.

In some embodiments, sensing the moveable throat blade in the wide gap position the method includes providing a switch activated by the moveable throat blade in the wide gap position, the switch configured to advance the shredder blades when the switch is activated. In other embodiments, sensing a shredder throat jammed condition includes sensing a predetermined motor torque value. In still other embodiments, sensing a shredder throat jammed condition includes sensing a predetermined force value against the moveable throat blade. In yet other embodiments, releasing the moveable throat blade in the shredder throat comprises manually releasing the moveable throat blade.

In additional embodiments sensing the moveable throat blade in the wide gap position includes providing a switch activated by the moveable throat blade in the wide gap position, in which the switch configured to advance the shredder blades when the switch is activated. In yet further embodiments, sensing the moveable throat blade in the wide gap position includes providing a manually-activated switch configured to advance the shredder blades when the switch is activated. In still other embodiments, sensing the shredder throat jammed condition includes providing a perceptible indication indicative of the shredder throat jammed condition. In some additional embodiments, moving the moveable throat blade to a wide gap position includes manually moving the moveable throat blade to a wide gap position using a push-button linkage. In other additional embodiments, moving the moveable throat blade to a wide gap position includes manually moving the moveable throat blade to a wide gap position using a turn-knob linkage.

BRIEF DESCRIPTION OF THE DRAWINGS

The invention is generally shown by way of reference to the accompanying drawings in which.

Some embodiments are described in detail with reference to the related drawings. Additional embodiments, features and/or advantages will become apparent from the ensuing description or may be learned by practicing the embodiment. In the figures, which are not drawn to scale, like numerals refer to like features throughout the description. The following description is not to be taken in a limiting sense, but is made merely for the purpose of describing the general principles of the embodiments.

DESCRIPTION

Figure 1:
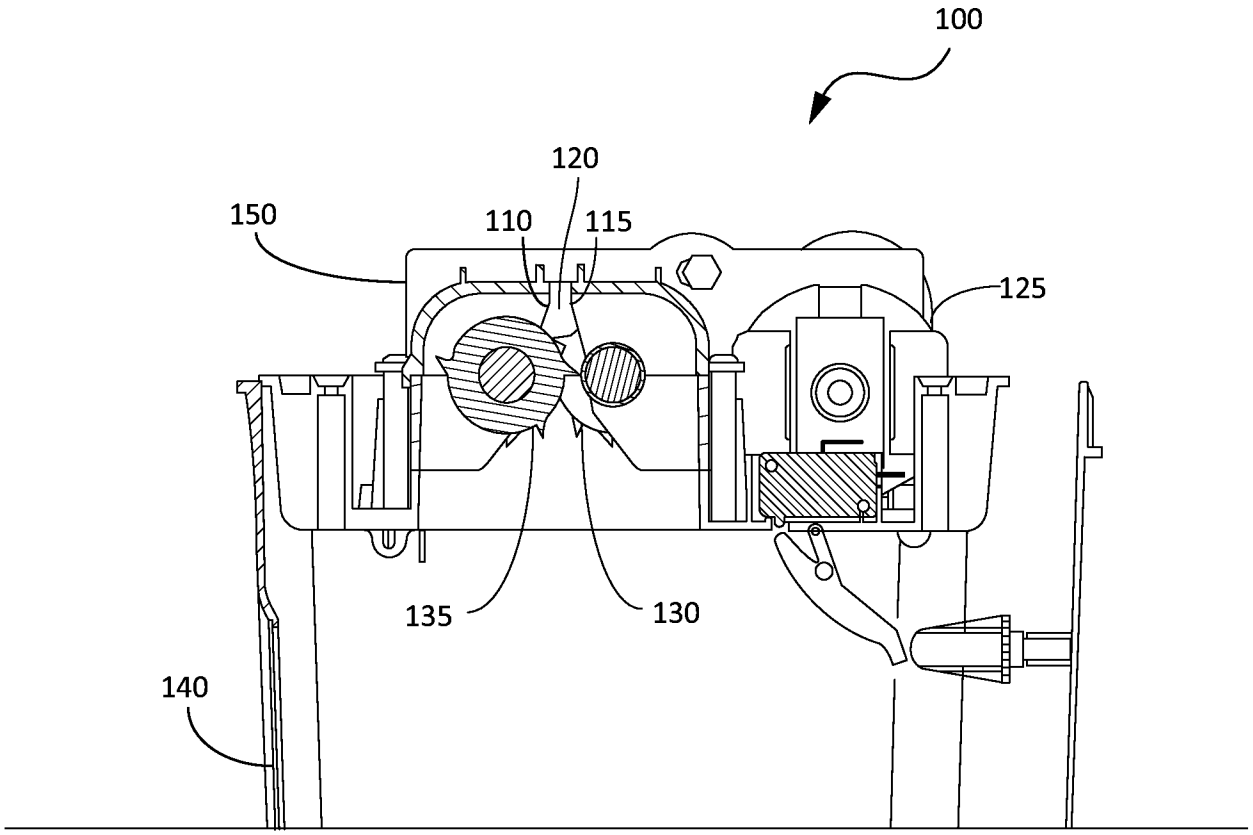
FIG. 1 is a side view illustration of a shredder.

Embodiments provide mechanisms to do away with paper shredder throat jams. In FIG. 1, exemplary conventional shredder 100 is shown having throat blades 110, 115 forming shredder throat 120. Material to be shredded (not shown) can be introduced into throat 120, and motor 125 can be activated. Motor 125 ultimately drives shredder blades 130, 135. If the amount of material introduced into throat 120 is not excessive, the shredding material will be comminuted into shreddant. If the amount of material is excessive, a jam can occur from a wad of shredding material in throat 120. In FIG. 1, throat blades 110, 115 can be fixed, rigid metal or plastic blades. At least a portion of one or both throat blades 110, 115 can be moveable. For example, at least a part of throat blade 115 can be moveable. When an excessive amount of material is introduced into shredder 100, throat 120 can become clogged and causing shredder blades 130, 135 to jam. Typically, a jam requires between about 10 lbs. to about 15 lbs. of force to clear the jam. In accordance with the embodiments herein, a jam may require as little as 1 lb. of force to clear the jam. In the embodiments herein, a shredder jam clear apparatus can be disposed in shredder upper cover 150. The shredder jam clear apparatus can make throat 120 wider when necessary (e.g., during a jam) but otherwise keep throat 120 in its narrower, nominal operating condition for safety.

In embodiments of shredder jam clear apparatus 200, as illustrated in FIG. 2 through FIG. 5, shredder inlet 205 is formed from at least two throat blades 210, 215 with one blade 215 being at least partly moveable to permit clearing of jams which may occur in the throat 220. Apparatus 200 can be provided with a jam indicator light 230 shown in FIG. 2, which, when illuminated, can indicate the presence of a jam. Such a presence can be sensed, for example, by a shredder torque measuring device on the shredder motor (not shown). Other perceptible indications of the presence of a jam may be provided, for example, without limitation, a flashing light, a beeper, a buzzer, or some other aural, visual, or external signal. A shredder having torque-based measurements is described in U.S. Pat. No. 8,967,509 (Ser. No. 13/506,586), filed Apr. 30, 2012, and assigned to the same assignee hereof, and which is incorporated herein by reference in its entirety. A decrease in motor operating speed, below a predetermined level, may be sensed by a torque sensor as being indicative of excessive torque representing motor overloading. Thus, a torque sensor may be used to indicate shredder jams.

Figure 2:
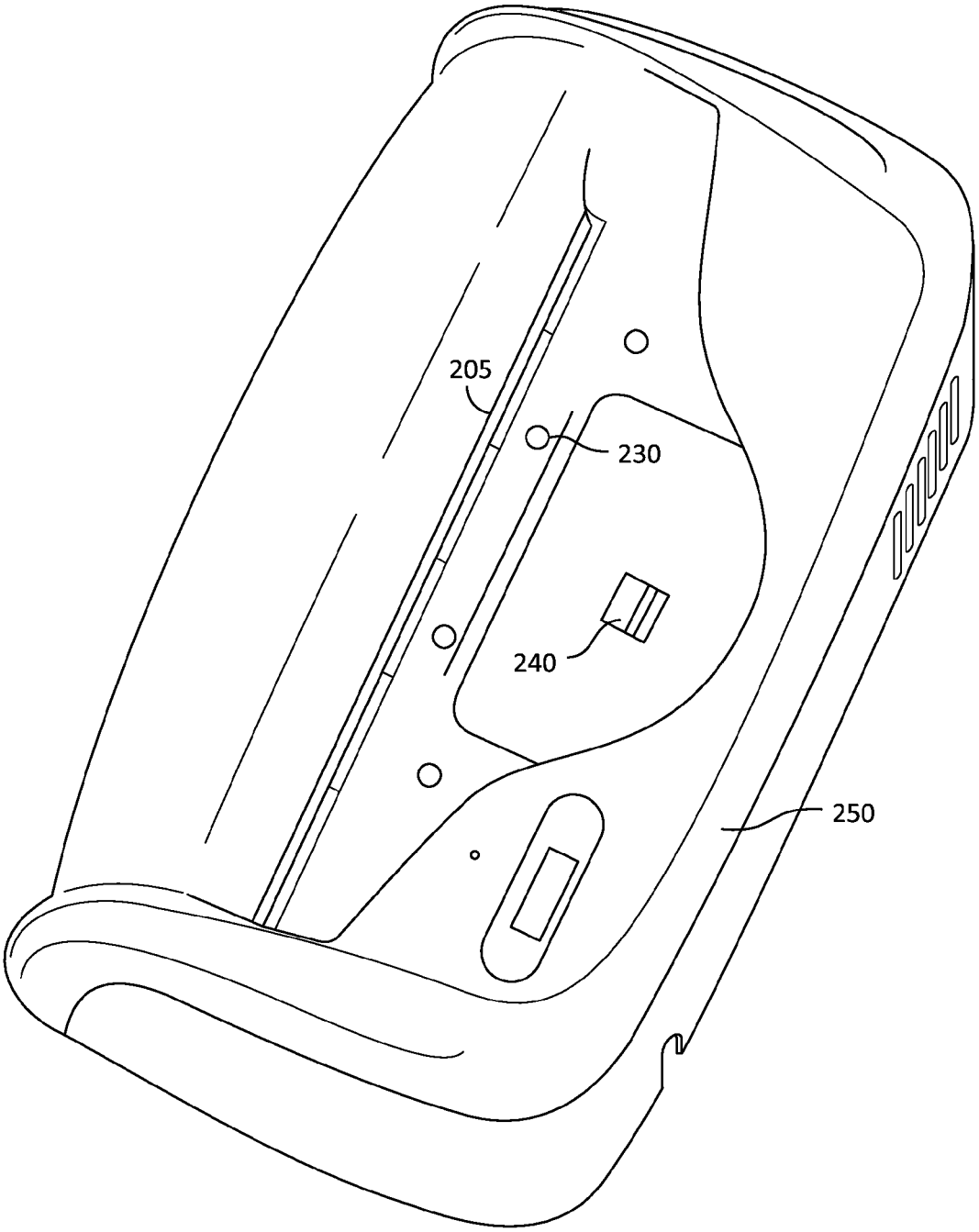
FIG. 2 is a view of an obverse side of a shredder cover of a first embodiment.
Figure 3:
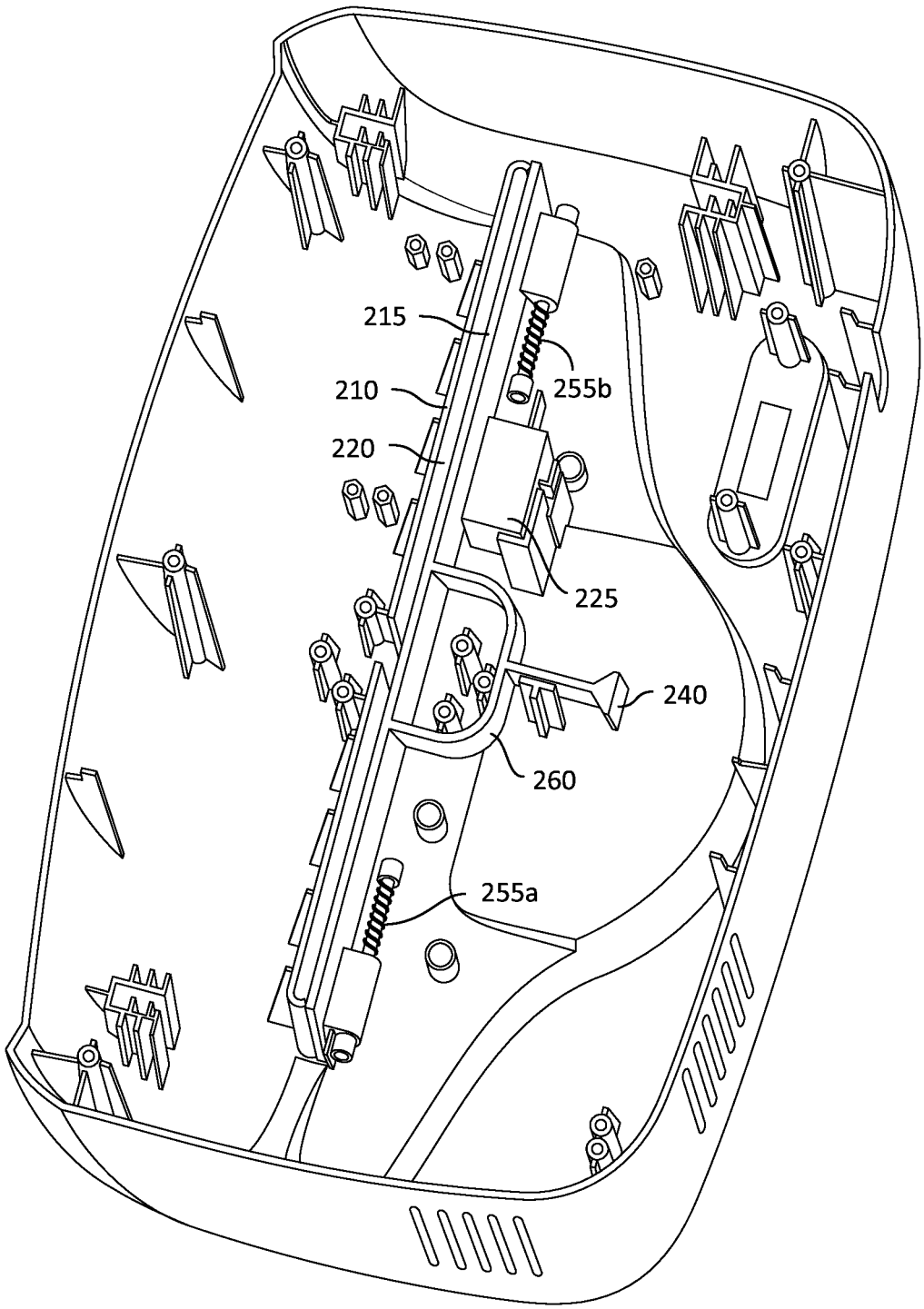
FIG. 3 is a view of the reverse side of the shredder cover in FIG. 2, with a push-button linkage.
Figure 4:
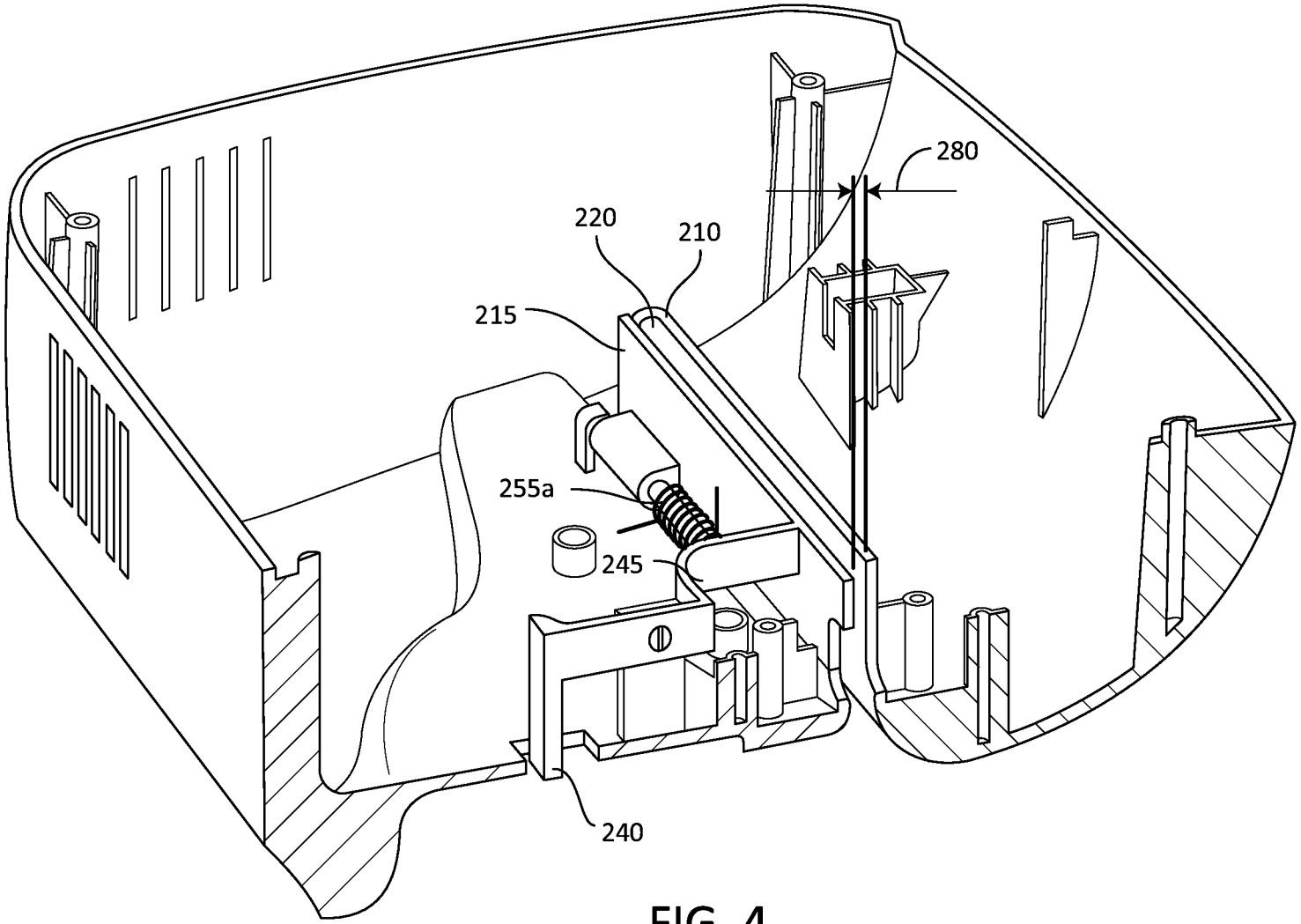
FIG. 4 is a cut-away view of the shredder cover of FIG. 3 in a nominal gap position.
Figure 5:
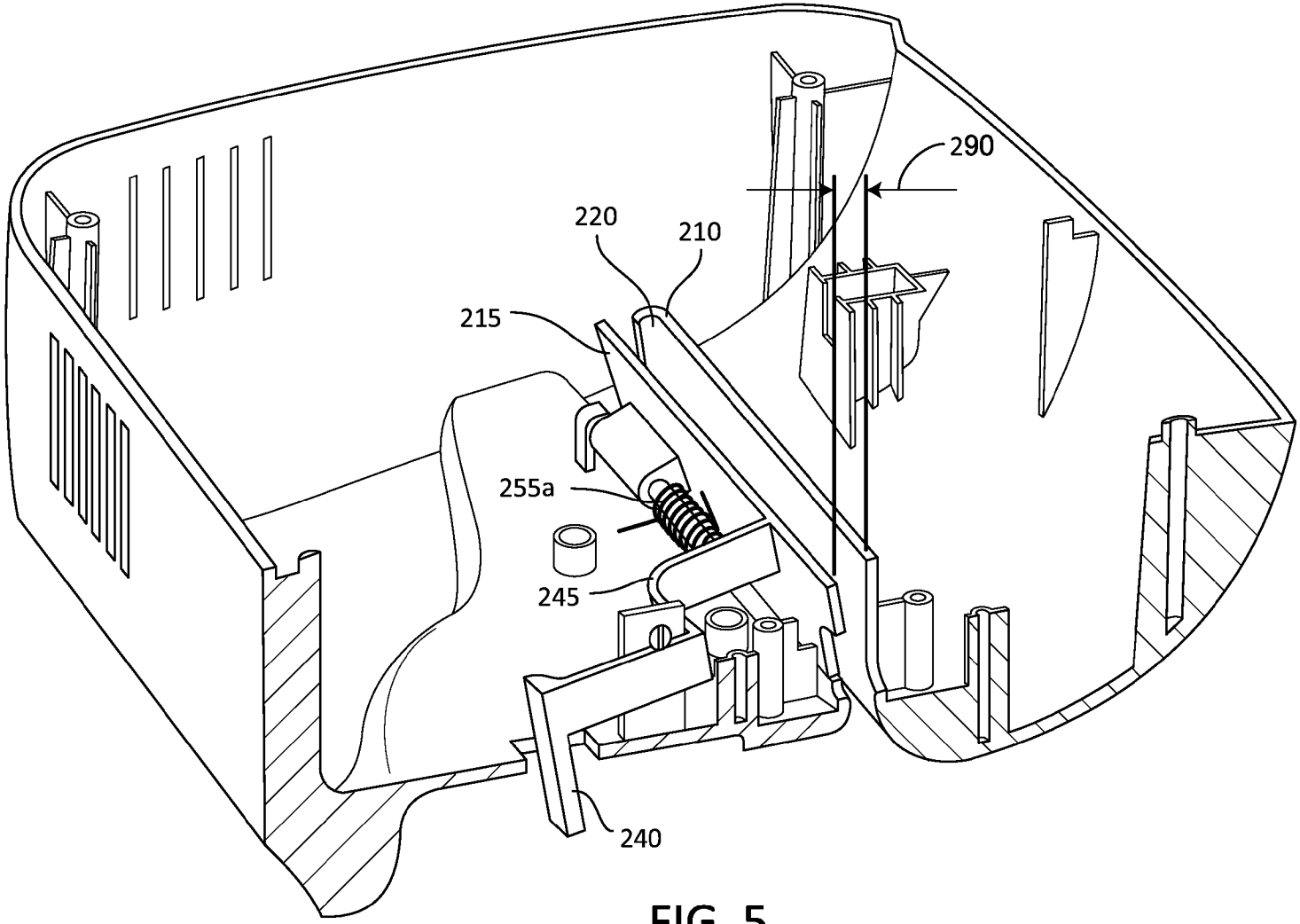
FIG. 5 is a cut-away view of the shredder cover of FIG. 3 in a wide gap position.

As seen in FIGS. 3-5, some embodiments provide jam clearing by moving at least a portion of throat blade 215, such that the confinement of the partially-shredded wad (not shown) in throat 220 can be released. In addition to the at least partly moveable blade 215, the shredder motor may be automatically activated by contact switch 225 when the throat blade 215, moves throat blade 215 from its nominal gap 280 to its wide gap 290. This allows the shredder blades (not shown) to comminute the wad without the user's hands coming into contact with the shredder blade, or without removing the cover of the shredder. To activate the feature, the user need only depress button 240 on the obverse exterior of the cover, as is illustrated in FIG. 2. Returning to FIGS. 3-5, the accompanying push-button linkage drives open throat blade 215 until it engages contact switch 225. Engaging switch 225 activates the anti jam feature. The initial (nominal) throat gap 280 may be about 4 mm, as is illustrated in FIG. 4. Depressing button 240 causes the D-shaped force-spreader 245 to pull back moveable throat blade 215 and be repositioned open relative to fixed throat blade 210. The repositioned (wide) throat gap 290 may be about 7 mm or more, as illustrated in FIG. 5. The repositioned throat blade 215 can activate jam-clearing switch 275, which causes the shredder blades (not shown) to engage, to move forward in the normal cutting motion, and to digest the now-freed jam. For example, a 4 mm throat can be opened to 7 mm, with the wider throat allowing for release of the wad from the throat and comminution of the jammed material. This jam-clearing occurs with shredder cover 250 in-place, so that the user's hands are not exposed to the shredder blades (not shown). D-shaped force-spreader 260 can be biased closed by springs 255*a, b* until released by button 240 and then repositioned when the button is no longer depressed.

Alternately, button 240 may be disposed to move upwards when first depressed allowing D-shaped force spreader 260 to move backwards away from fixed throat blade 210, being biased open by springs 255*a, b*. In turn, moveable throat blade 215 is pulled back away from blade 210 causing throat gap 290 to be widened relative to its nominal position, for example, 7 mm instead of 4 mm. By depressing switch 240 again, D-shaped force spreader 260 advances toward fixed throat blade 210 and latches in position when full travel of button 240 is realized.

Figure 6:
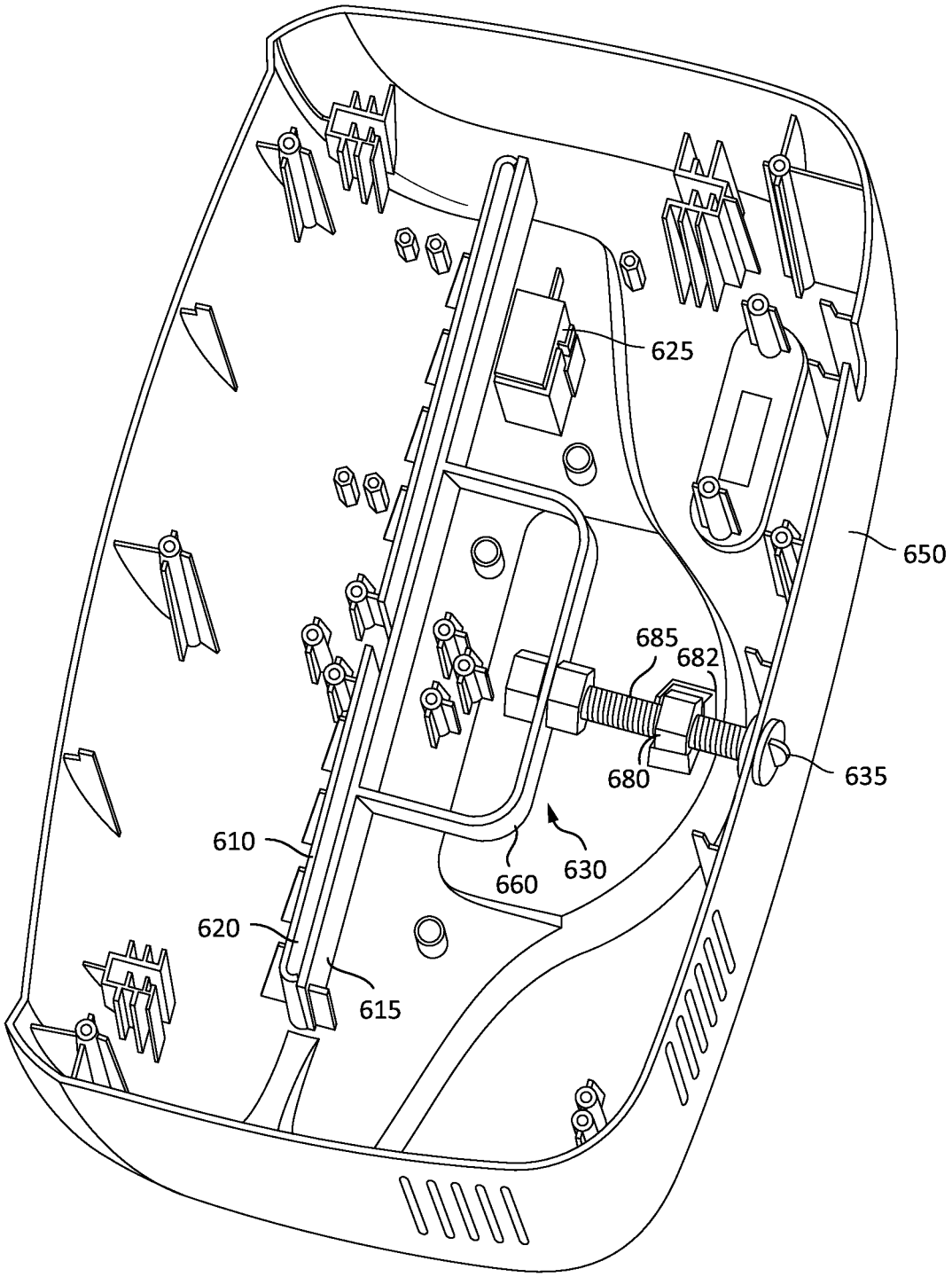
FIG. 6 is a view of an obverse side of a shredder cover of another embodiment, with a turn-knob linkage.
Figure 7:
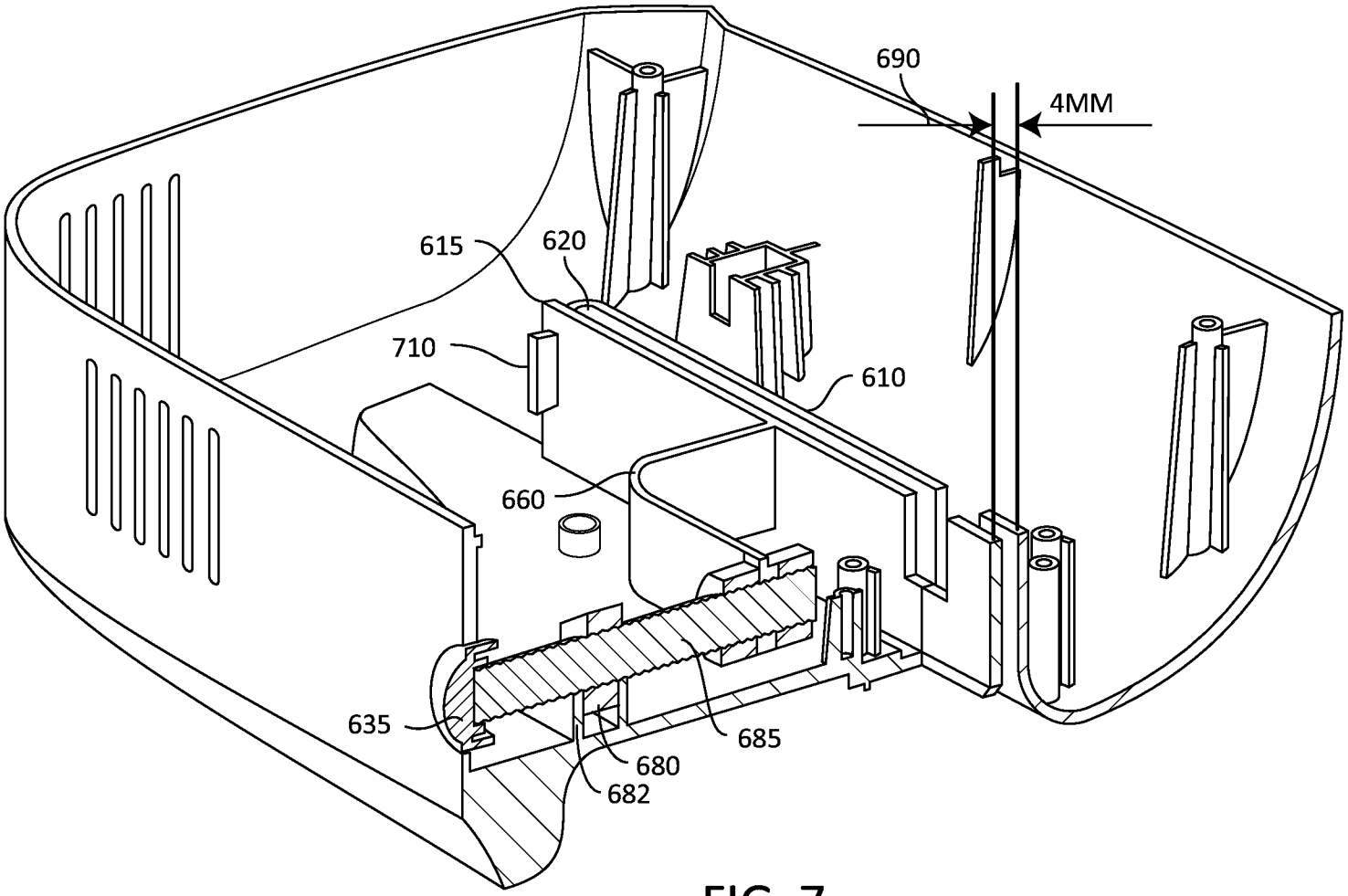
FIG. 7 is a cut-away view of the shredder cover of FIG. 6 in a nominal gap position.
Figure 8:
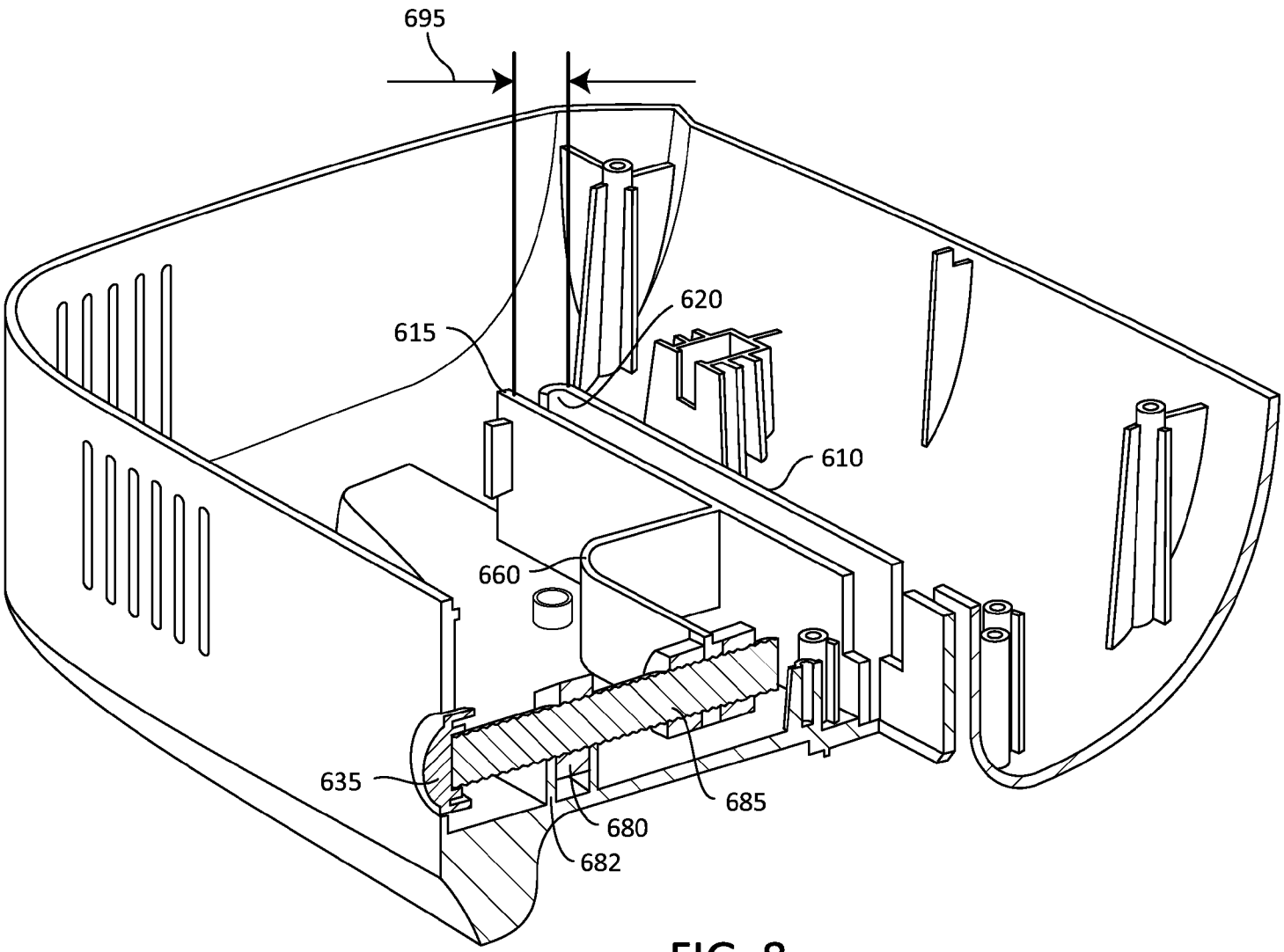
FIG. 8 is a cut-away view of the shredder cover of FIG. 6 in a wide gap position.

In other embodiments, shown in FIGS. 6 through 9, shredder jam clear apparatus 600 is described. In FIG. 6, shredder throat 620 can be formed from at least two throat blades 610, 615. One throat blade 615 can be released by a turn-knob 635, which turn-knob 635 may be situated at the rear of cover 650. Turn knob 635 can be provided with linkage 630, which may include a D-shaped force spreader 660 pressing upon the releasable throat blade 615. Linkage driveshaft 685 can be coupled to turn-knob 635 on one end and force spreader 660 on the other end. As illustrated in FIG. 7, positioning apparatus 680, which may be a captured nut, can guide driveshaft 685 to move forwards or backwards, thus translating rotating motion into linear motion. Apparatus 680 may include a nut capturing device 682. FIG.

Figure 9:
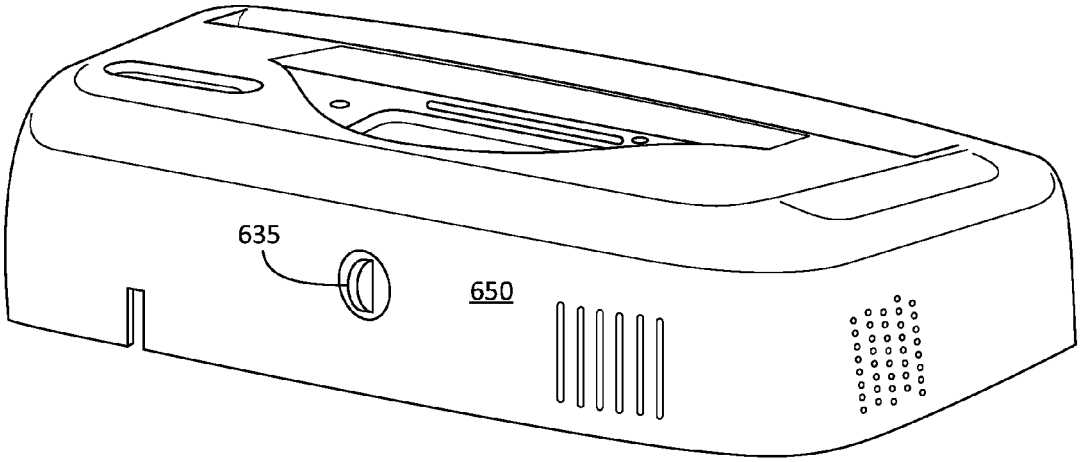
FIG. 9 is a perspective view of the obverse side of the shredder cover in FIG. 6, with the turn-knob linkage.

8 illustrates that as turn-knob 635 is rotated, for example, by one-quarter turn counterclockwise, the D-shaped force spreader 660 and attached releasable throat blade 615 can be backed away from the fixed throat blade 610, opening throat 620 wider, relative to a normal operating gap 690 of about 4 mm. A jam—clearing gap 695 can be, for example, 7 mm. FIG. 9 depicts placement of turn-knob 635 on the obverse-rear side of cover 650.

When releasable throat blade 615 reaches the maximum opening point, it can activate the jam-clearing switch 625, which causes the shredder blades to engage and operate in the forward direction, digesting the wad. For example, a 4 mm throat can be opened to 7 mm, with the wider throat 620 allowing for release of the wad from the throat 620 and comminution of the jammed material. An opening wider than 7 mm also can be provided to clear throat 620. When the wad is cleared, turn-knob 635 can be turned in the reverse direction, causing the releasable throat blade 615 to return to its normal operation gap 690 relative to fixed blade 610 and causing jam-clearing switch 625 to be de-activated.

Figure 10:
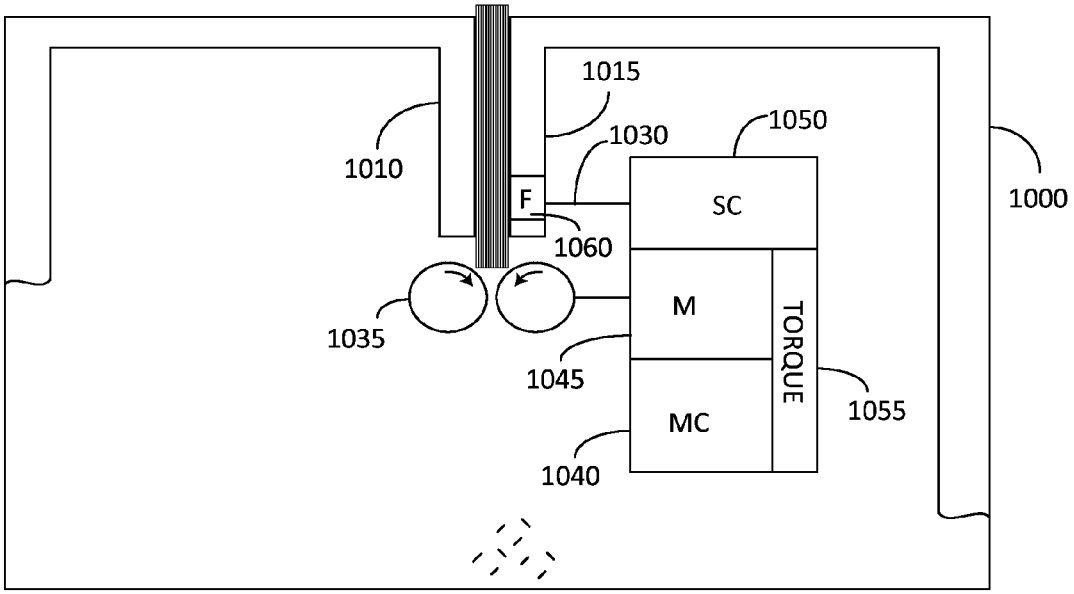
FIG. 10 is a side-view cut-away illustration of some shredder embodiments, having a moveable throat in a nominal gap position.
Figure 11:
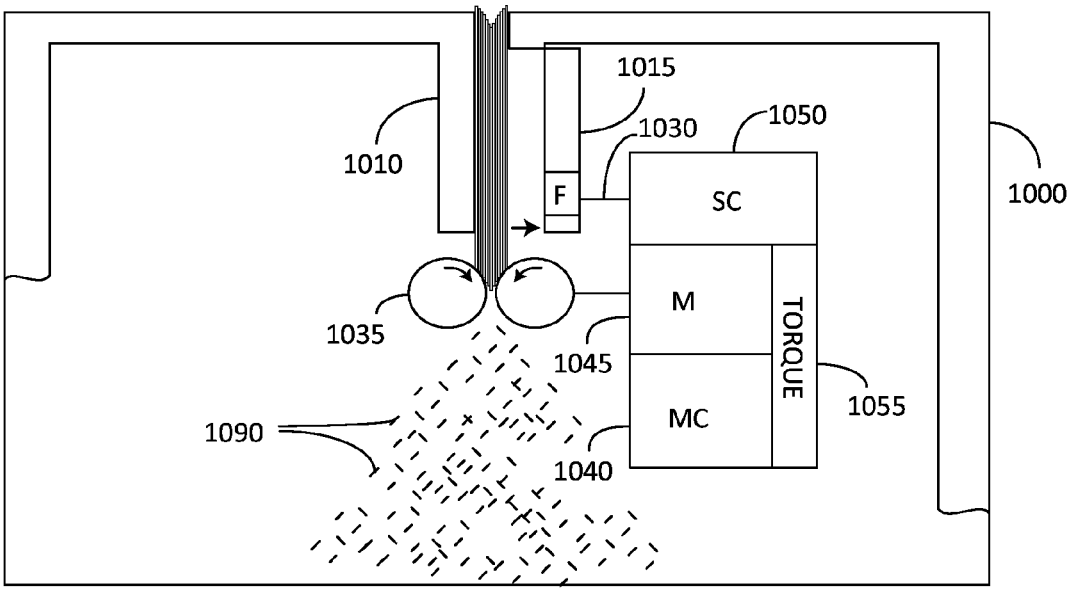
FIG. 11 is a side-view cut-away illustration of FIG. 10, having a moveable throat in a wide gap position.

In yet other embodiments, the shredder jam clear mechanism can be automated. In FIGS. 10 and 11, the paper shredder 1000 may include fixed throat blade 1010, moveable throat blade 1015, throat 1020, actuator arm 1030 coupled to moveable throat blade 1015, shredder blades 1035 coupled to motor controller 1040, and motor 1045, shredder controller 1050, torque sensor 1055 coupled to motor controller 1040, motor 1045, and shredder controller 1050, shredding material 1075, and shreddant 1090. For example, without limitation, the jam may be sensed by torque sensor 1055 in motor 1045; actuator arm 1030 may be actuated by a solenoid in shredder controller 1050. An increase in motor torque beyond a predetermined torque limit can indicate a paper jam in throat 1020. In FIG. 10, a larger-than-nominal amount of shredding material 1075 can be introduced into throat 1020. This causes the paper shredder blades to slow down and strain. The increased torque generated by the overload condition is sensed by torque sensor 1055. Alternatively, a strain gauge or force sensor 1060 may be mounted on or in a flexible moveable throat blade 1015, or in fixed blade 1010, and sensed by shredder controller 1050. As shown in FIG. 11, whether increased torque, or increased strain or force, is detected, a motor overload condition can be sensed, causing actuator arm 1030 to retract, for example, using a solenoid. Retraction of actuator arm 1030 can pull back moveable throat blade 1015, and shredder controller 1050 causes motor 1045 to advance shredder blades 1035. The wide throat gap (e.g., about 7 mm) created by retracting moveable throat blade 1015 can ameliorate the overload condition such that the shredding material 1075 can be successfully comminuted into shreddant 1090. Once the overload condition has passed, and normal shredding operation is sensed, for example, by the motor torque sensor 1055, or force sensor 1060, shredder controller 1050 can cause actuator arm 1030 to return moveable throat blade 1020 to normal operating conditions and normal throat gap (e.g., about 4 mm). The shredder may turn off, in waiting for a new load of shredding material.

Figure 12:
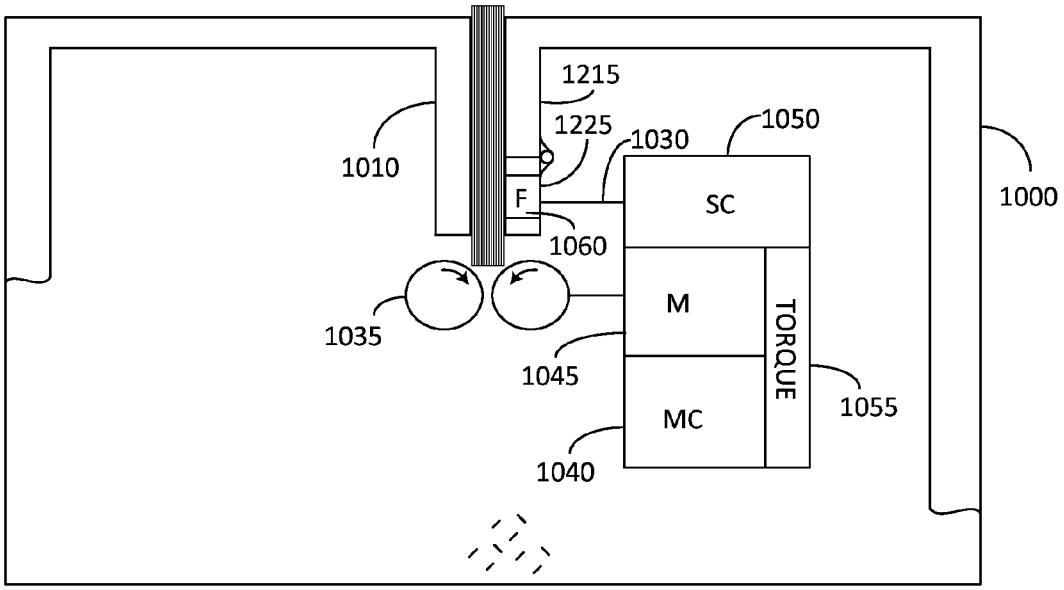
FIG. 12 is a side-view cut-away illustration of other shredder embodiments, having a moveable throat with a release bar in a nominal gap position.
Figure 13:
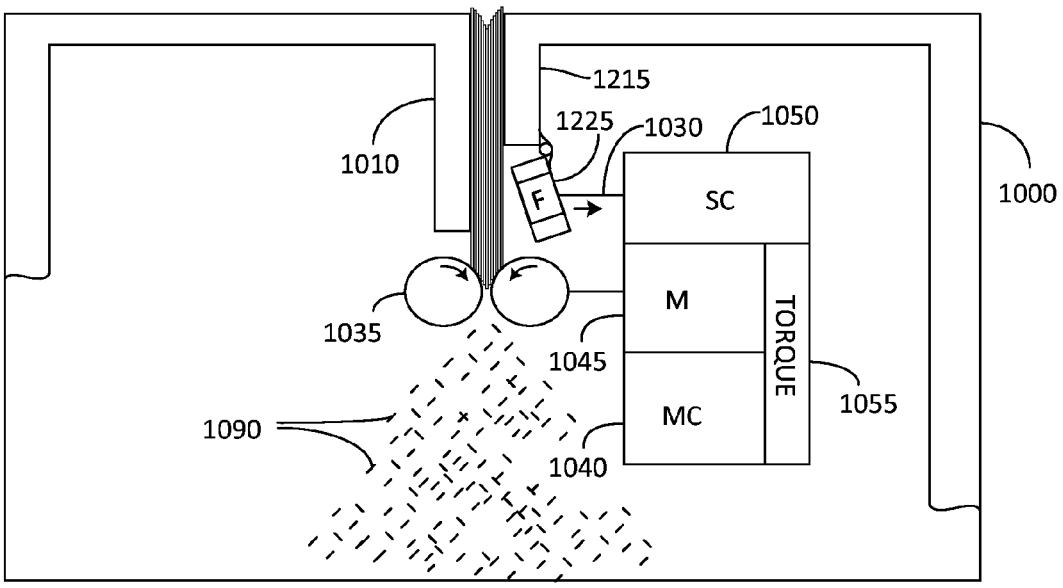
FIG. 13 is a side-view cut-away illustration of FIG. 12, having a moveable throat with a release bar in a wide gap position.

In FIGS. 12 and 13, at least a portion of throat inlet blade 1215 can be coupled to a release bar 1225. FIG. 12 can be similar to FIG. 10. Release bar 1225 can be formed from a hinged, spring-loaded throat flap portion, which can be held in place by actuator arm 1030. A torque sensor 1055 may be used to detect an overload or jam event. Alternatively, a strain gauge or force sensor 1060 may be mounted on or in a flexible moveable throat blade 1015, and sensed by shredder controller 1050.

As illustrated in FIG. 13, when an overload is sensed, for example without limitation, by torque sensor 1055, or by force sensor 1060, shredder controller 1050 can cause actuator arm 1030 to release spring-loaded release bar 1225. Shredder controller 1050 can activate anti jam features by causing shredder blades 1035 to move forward. The additional space given to the shredding material 1075 allows shredder blades 1035 to comminute shredding material 1075 into shreddant 1090.

In yet other embodiments, release bar 1225 may be released by a push button mechanism, similar to that described with respect to FIGS. 2-5. In still other embodiments, release bar 1225 may be released by a turn-knob mechanism as described with respect to FIGS. 6-9. In either embodiment, the opening of the release bar could activate jam-clearing switch, such as switch 225, which causes the shredder blades 1035 to engage and operate in the forward direction, digesting the jamming wad. Alternatively to anti-jam switch 225, an electro-optic device may be used.

Figure 14:
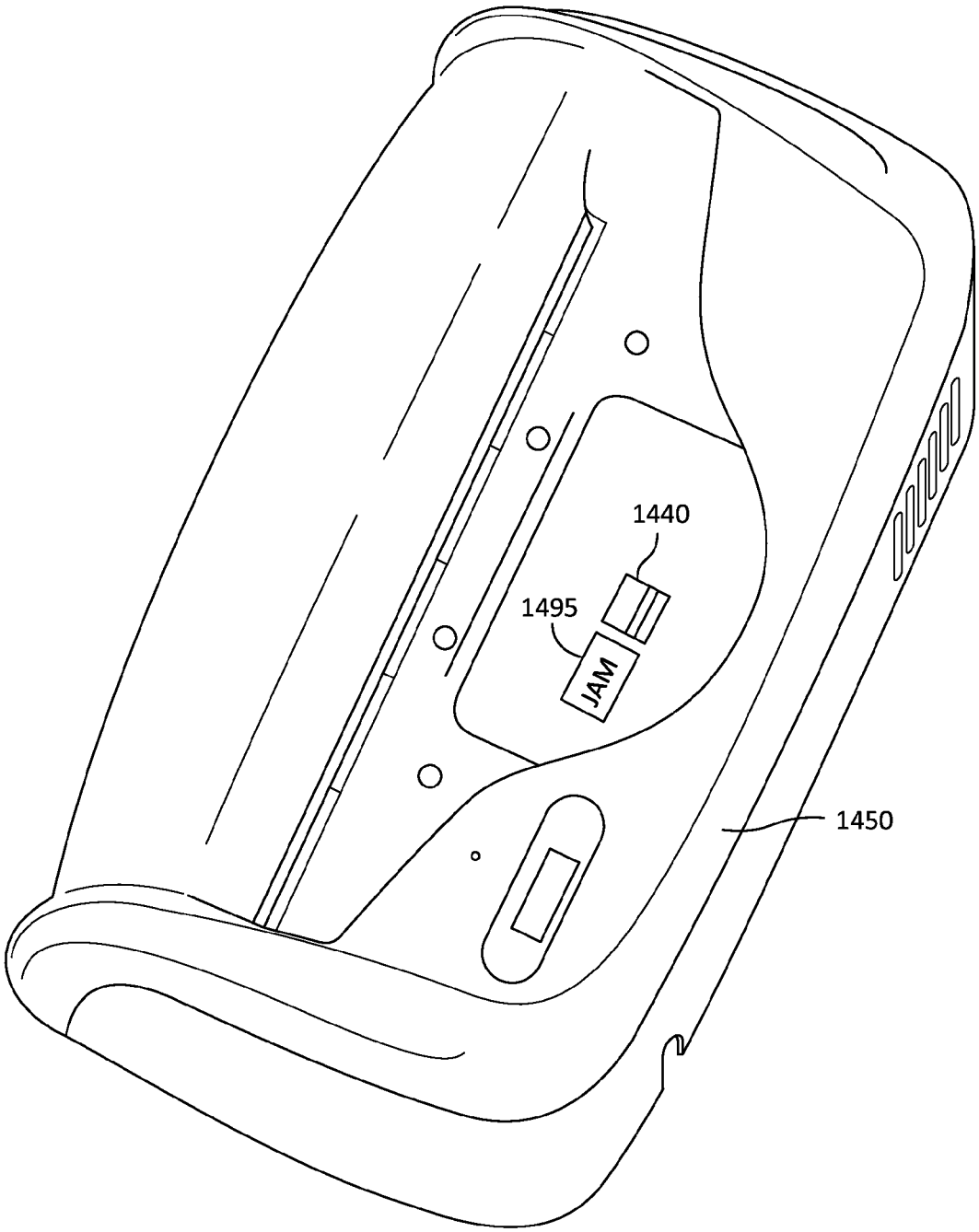
FIG. 14 is a top illustration of an obverse side of another embodiment, having push-button linkage and manual push-button anti-jam activation.

In yet additional embodiments, the jam-clearing switch can be manually activated. For example, in FIG. 14, similar to the description regarding FIG. 2, by pressing a first button 1440 on cover exterior 1450, the moveable throat blade (not shown) can be released into its wide gap setting. Then, pressing a second button 1495, the anti jam feature can be activated such that the shredder blades (not shown) move forward and the jamming wad of shredding materials is comminuted into shreddant, clearing the shredder jam.

Figure 15:
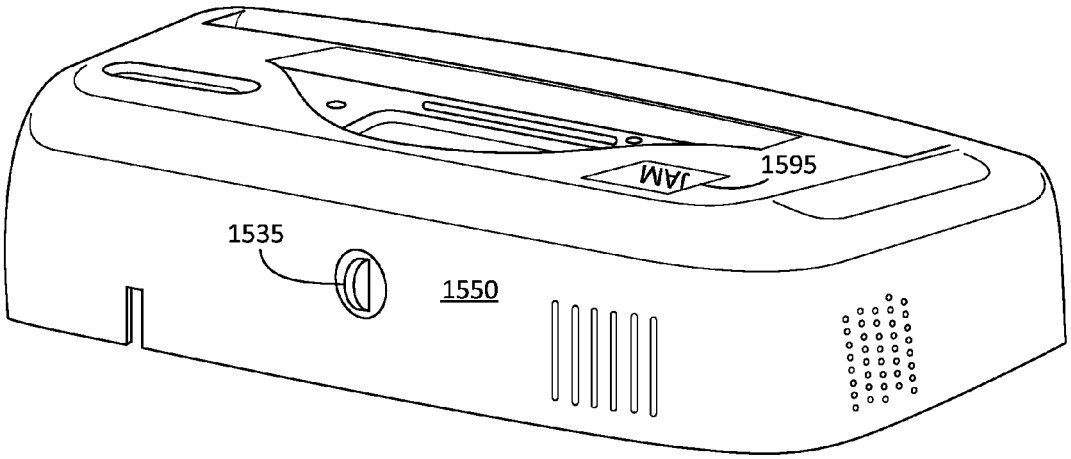
FIG. 15 is a perspective illustration of an obverse side of yet another embodiment, having turn-knob linkage and manual push-button anti jam activation.
Figure 16:
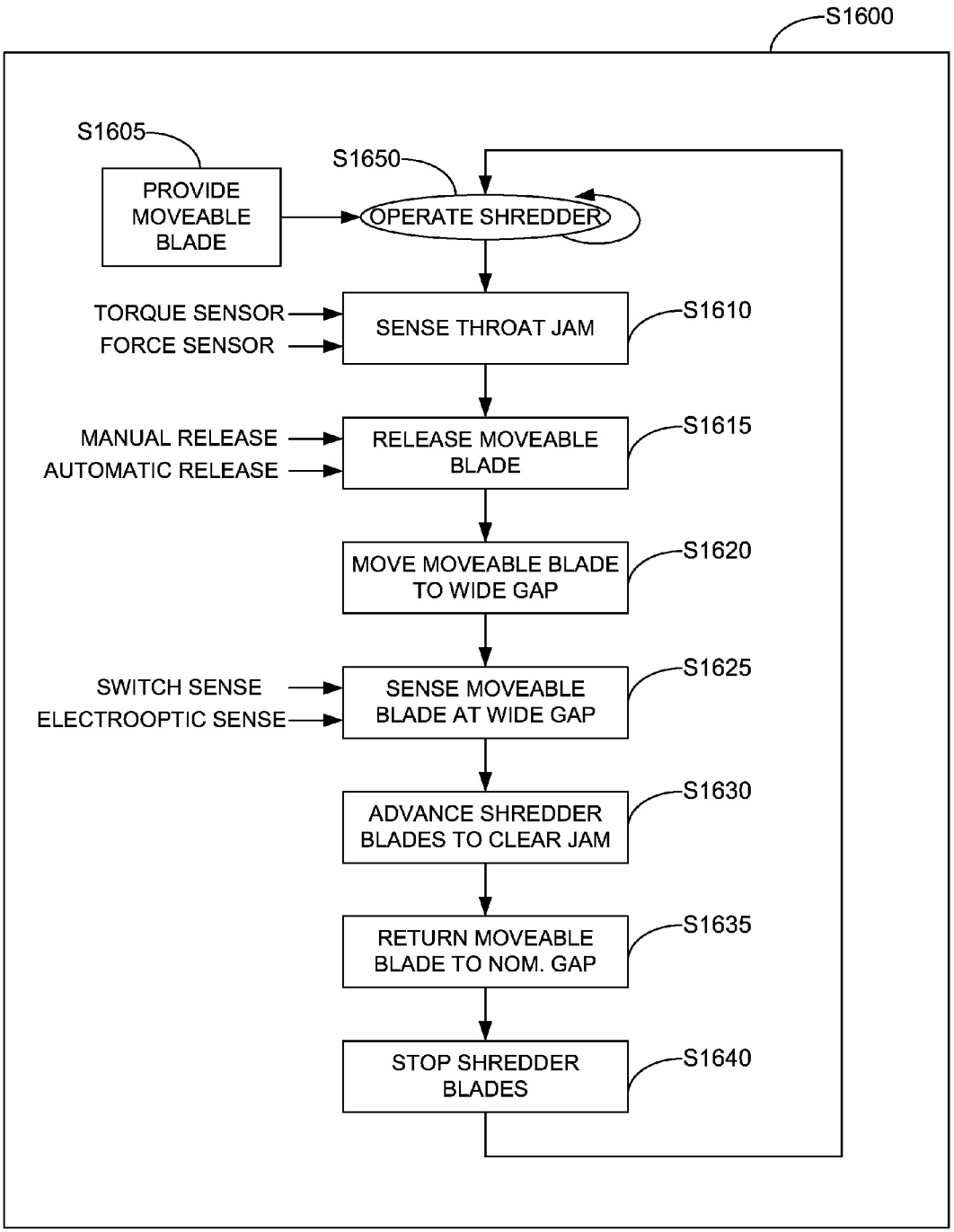
FIG. 16 is a block diagram of exemplary methods.

Similar to the description relative to FIG. 9, in FIG. 15, turn-knob 1535 may be disposed on the exterior cover 1550 of the shredder. By turning knob 1535, the moveable throat (not shown) may be released into its wide gap setting. Then, pressing a second button 1595, the anti jam feature can be activated such that the shredder blades (not shown) move forward and the jamming wad of shredding materials is comminuted into shreddant, clearing the shredder jam. In FIG. 16, a method 1600 for recovering from a shredder jam in a paper shredder is provided. The paper shredder is provided (S1605) with a moveable throat blade in the paper shredder inlet throat, as is described above. Method 1600 proceeds from, while operating the paper shredder sensing (S1610) a shredder throat jammed condition, for example, using a shredder motor torque sensor or a throat blade force sensor, releasing (S1615) the moveable throat blade in the shredder throat, for example, using a press-button manual linkage, a turn-knob linkage, or an automated actuator arm, and moving (S1620) the moveable throat blade to a wide gap position, which relieves the confined shredding material jammed in the shredder inlet throat. Sensing (S1625) the moveable throat blade in the wide gap position can be a switch which, when actuated, advances (S1630) the paper shredder blades in order to clear the jam. Advancing S1630 can be by manual switch or it can be automated. Sensing S1625 also may be performed by an electro-optic sensor. Once the jam has been digested, the moveable throat blade can be returned (S1635) to its nominal gap position. With the jam digested and the moveable throat blade returned to its nominal gap position, the shredder blades can be turned off (S1640) in preparation for normal jam-free operations (S1650).

In the above embodiments, the motor can move forward to comminute the jammed wad of shredding material. However, the motor also may momentarily move in reverse in order to dislodge the jammed wad, and then move forward to digest the jammed wad into shreddant. Although 4 mm has been given as a nominal shredder inlet gap, of course, the nominal gap size may vary with the nominal amount of material that a shredder may comminute. Similarly, although 7 mm has been provided as a maximum, the maximum gap size may similarly vary as with the nominal shredder inlet gap. Also, a shredder may be provided with a flexible, moveable shredder throat to facilitate manual removal when there is a jam.

Although the present embodiments have been described by way of example with references to the current drawings, it is to be noted herein that various changes and modifications will be apparent to those skilled in the art. Therefore, unless such changes and modifications depart from the scope of the present invention, they should be construed as being included therein.

The invention claimed is:

1. A paper shredder, comprising:

a shredder throat, coupled to an inlet in a shredder cover and in proximity to shredder blades, the shredder throat having a moveable throat blade, wherein the moveable throat blade provides a wide shredder throat; and an anti jam switch disposed to cause a motor to advance the shredder blades to clear a jam in the wide shredder throat.

2. The paper shredder of claim 1, wherein the moveable throat blade is moved manually.

3. The paper shredder of claim 2, wherein the anti jam switch is activated by contact with the moveable throat blade.

4. The paper shredder of claim 3, wherein the moveable throat blade is moved with a push-button linkage accessible by the shredder cover, and the wide moveable throat blade activates the anti jam switch.

5. The paper shredder of claim 3, wherein the moveable throat blade is moved with a turn-knob linkage accessible by the shredder cover, and the wide moveable throat blade activates the anti jam switch.

6. The paper shredder of claim 1, wherein the anti jam switch is activated by a switch button on the shredder cover after moving the moveable throat blade.

7. The paper shredder of claim 1, wherein the moveable throat blade widens automatically upon a signal.

8. The paper shredder of claim 7, wherein the anti jam switch activates automatically upon a signal.

9. The paper shredder of claim 8, wherein the signal is a torque-based measurement from the motor.

10. The paper shredder of claim 8, wherein a force sensor is disposed in the moveable blade capable of sensing a jam in the shredder throat and the signal is a force signal from the moveable blade.

11. A method for recovering from a shredder jam in a paper shredder, comprising:

providing a moveable throat blade in the shredder throat;

sensing a shredder throat jammed condition;

releasing the moveable throat blade in the shredder throat;

moving the moveable throat blade to a wide gap position;

sensing the moveable throat blade in the wide gap position;

advancing shredder blades in response to the sensing, wherein the jammed condition is cleared;

returning the moveable throat blade to a nominal gap position; and turning off the shredder blades in response to the returning.

12. The method of claim 11, wherein sensing the moveable throat blade in the wide gap position comprises:

providing a switch activated by the moveable throat blade in the wide gap position, the switch configured to advance the shredder blades when the switch is activated.

13. The method of claim 11, wherein sensing a shredder throat jammed condition comprises sensing a predetermined motor torque value.

14. The method of claim 11, wherein sensing a shredder throat jammed condition comprises sensing a predetermined force value against the moveable throat blade.

15. The method of claim 11, wherein releasing the moveable throat blade in the shredder throat comprises manually releasing the moveable throat blade.

16. The method of claim 15, wherein sensing the moveable throat blade in the wide gap position comprises:

providing a switch activated by the moveable throat blade in the wide gap position, the switch configured to advance the shredder blades when the switch is activated.

17. The method of claim 15, sensing the moveable throat blade in the wide gap position comprises:

providing a manually-activated switch configured to advance the shredder blades when the switch is activated.

18. The method of claim 11, wherein sensing the shredder throat jammed condition comprises providing a perceptible indication indicative of the shredder throat jammed condition.

19. The method of claim 11, wherein moving the moveable throat blade to a wide gap position comprises manually moving the moveable throat blade to a wide gap position using a push-button linkage.

20. The method of claim 11, wherein moving the moveable throat blade to a wide gap position comprises manually moving the moveable throat blade to a wide gap position using a turn-knob linkage.

* * * * *